US006536394B2

(12) United States Patent
Schneider

(10) Patent No.: US 6,536,394 B2
(45) Date of Patent: Mar. 25, 2003

(54) INTERNAL-COMBUSTION ENGINE, IN PARTICULAR FOR MOTORCYCLES

(75) Inventor: Andreas Schneider, Leonberg (DE)

(73) Assignee: Harley-Davidson Motor Company Group, Inc., Milwaukee, WI (US)

( * ) Notice: Subject to any disclaimer, the term of this patent is extended or adjusted under 35 U.S.C. 154(b) by 0 days.

(21) Appl. No.: 09/909,146

(22) Filed: Jul. 19, 2001

(65) Prior Publication Data

US 2002/0023606 A1 Feb. 28, 2002

(30) Foreign Application Priority Data

Aug. 24, 2000 (DE) ..... 100 41 484

(51) Int. Cl.[7] ..... F02M 35/10

(52) U.S. Cl. ..... 123/184.21; 123/184.61; 123/184.55

(58) Field of Search ..... 123/184.21, 184.55, 123/469, 470, 184.61, 590; 29/888.01

(56) References Cited

U.S. PATENT DOCUMENTS 4,066,720 A * 1/1978 Carter ..... 261/44.3
4,711,225 A * 12/1987 Holderle et al. ..... 123/590
4,903,644 A 2/1990 Groger et al.
5,065,708 A * 11/1991 Wehle et al. ..... 123/73 C
5,445,130 A 8/1995 Brummer et al.
5,474,039 A * 12/1995 Doragrip ..... 123/184.55
5,477,819 A 12/1995 Kopec

FOREIGN PATENT DOCUMENTS

| | | |
|---|---|---|
| DE | 4418001 A1 | 12/1994 |
| DE | 19757986 A1 | 7/1999 |
| EP | 0245001 | 11/1989 |
| EP | 0384359 | 9/1993 |

* cited by examiner

*Primary Examiner*—Henry C. Yuen
*Assistant Examiner*—Katrina B. Harris
(74) *Attorney, Agent, or Firm*—Michael Best & Friedrich LLP

(57) ABSTRACT

A fuel supply device is mounted to a motorcycle engine between two substantially identical air intake connections. The air intake connections each include a body portion with a projection and a flange, each extending radially from the body portion. Fasteners inserted through apertures in the flanges hold the air intake connections to the engine. The protrusion is preferably made of a resilient material, such as rubber. The flange is preferably made of a non-resilient material, such as aluminum. An aperture having an annular recess extends through the projection. The aperture is adapted to receive an internally threaded metal sleeve having an annular protrusion that surrounds the metal sleeve. A threaded fastener preferably extends through the metal sleeve and couples the fuel supply device to the projection. In the event that the fastener is excessively torqued during tightening the metal sleeve can spin in the aperture without damaging the projection.

29 Claims, 7 Drawing Sheets

INTERNAL-COMBUSTION ENGINE, IN PARTICULAR FOR MOTORCYCLES

FIELD OF THE INVENTION

This invention relates to an apparatus and a method for mounting a fuel supply device in an internal-combustion engine, in particular for a motorcycle.

BACKGROUND OF THE INVENTION

In the case of internal-combustion engines, it is known to fasten the fuel distributor directly to the cylinder head of the engine. The fuel distributor is preferably mounted relatively closely to the engine to conserve space and to reduce the distance that fuel must travel inside the engine. Unfortunately, mounting the fuel distributor on the cylinder head subjects the fuel distributor to substantial engine vibration and to high temperatures during operation. As a result, there is a risk that the fasteners or the entire fuel supply device will be damaged. Also, thermal expansion may cause the fuel supply device to unfasten itself from the engine or may damage the fasteners which hold the fuel supply device on the engine.

A need therefore exists for a fastening apparatus and a method of fastening a fuel supply device to an internal-combustion engine which reduces the vibration transmitted to the fuel supply device, is resistant to damage caused by engine heat, is arranged in a space saving manner, can adapt to accommodate thermal expansion, and provides a relatively short path between the fuel supply device and the rest of the engine.

SUMMARY OF THE INVENTION

The present invention provides an improved air intake connection capable of supporting a fuel supply device on a motorcycle engine. Preferably, the motorcycle engine includes two cylinders in a V-shaped configuration. In alternative embodiments of the present invention, the engine can have any number of cylinders, including one, two, three, or four. Similarly, the engine can have a V-shaped configuration or can have an in-line or a straight configuration. In embodiments with more than one cylinder, it may be desirable to mount the fuel supply device between two air intake ports. Alternatively, given the particular configuration of the engine, it may be desirable to mount the fuel supply device to a single cylinder. Similarly, the configuration of the particular engine may make it more desirable to mount the fuel supply device to three, four, or more air intake ports.

In a first aspect of the present invention, a fuel supply device is mounted to two air intake connections. The air intake connections each have a body portion, a flange extending radially from the body portion, and a projection that extends radially from the body portion. The body portion is made of a relatively resilient material and the flange is made of a relatively non-resilient material. Preferably, the flange is aluminum and the body portion is rubber. The air intake connection is preferably mounted to the engine with one or more fasteners inserted through the flange.

For mounting the fuel supply device to the air intake connections, each projection includes an aperture extending therethrough. An annular recess extends around the inside wall of each of the aperture. A sleeve with an annular protrusion extending radially around the sleeve is preferably inserted into the aperture. The annular recess is adapted to receive the annular protrusion in positive locking engagement. In this manner, the sleeve is coupled to the projection and can rotate inside the aperture in the protrusion but cannot slide out of the aperture. Therefore, the sleeve remains in positive locking engagement with the protrusion when the sleeve rotates relative to the aperture in the protrusion. A fastener is inserted through a fastening lug in the fuel supply device and into the sleeve to secure the fuel supply device to the air intake connection. In this manner, the fastener can be tightened to hold the fuel supply device to the air intake connection. In the event that the fastener is excessively torqued during tightening, the sleeve can spin in the aperture without damaging the projection or the aperture in the projection.

Additionally, because the flanges are preferably made of a relatively resilient material, a change in distance between the two air intake connections caused by thermal expansion does not damage the apertures in the protrusions. Preferably, the metal fasteners rotate inside the apertures to accommodate thermal expansion in the engine, which can include the cylinder heads moving toward each other, moving away from each other, or rotating with respect to each other. Further advantageous embodiments and improvements of the apparatus and method for mounting a fuel supply device in an internal-combustion engine according to the invention are described below.

BRIEF DESCRIPTION OF THE DRAWINGS

The present invention is further described with reference to the accompanying drawings, which show a preferred embodiment of the present invention. However, it should be noted that the invention as disclosed in the accompanying drawings is illustrated by way of example only. The various elements and combinations of elements described below and illustrated in the drawings can be arranged and organized differently to result in embodiments which are still within the spirit and scope of the present invention.

In the drawings, wherein like reference numerals indicate like parts.

DETAILED DESCRIPTION OF THE ILLUSTRATED EMBODIMENT

The present invention is described herein as including a four-stroke two-cylinder engine. However, the present invention can be used with almost any number of cylinders, such as one, two, three, four, five, and six cylinders with equal effectiveness. Similarly, the present invention can be used with two-stroke engines. Finally, reference is made to engines having a V-shape. One having ordinary skill in the art will appreciate that the present invention can be used with V-shaped engines and with in-line or straight engines with equal effectiveness. As such, the present invention can include embodiments in which the configuration of the engine includes any conventional motorcycle engine and is not limited to the embodiments referred to herein. For simplicity only, the following description will continue to refer to four-stroke two cylinder V-shaped engines.

Figure 1:
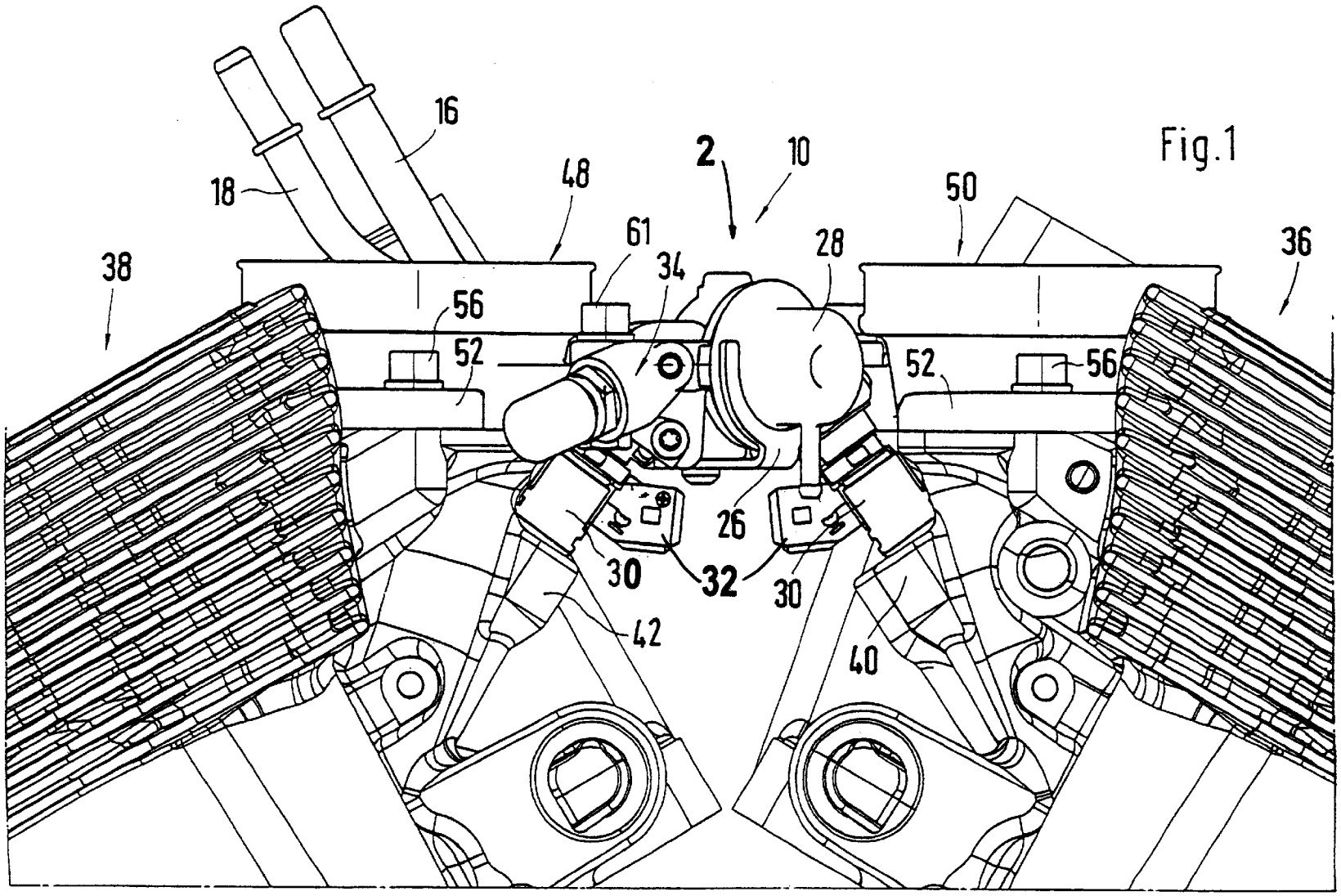
FIG. 1 is a side view of an internal-combustion engine with a fuel supply device mounted thereto.
Figure 2:
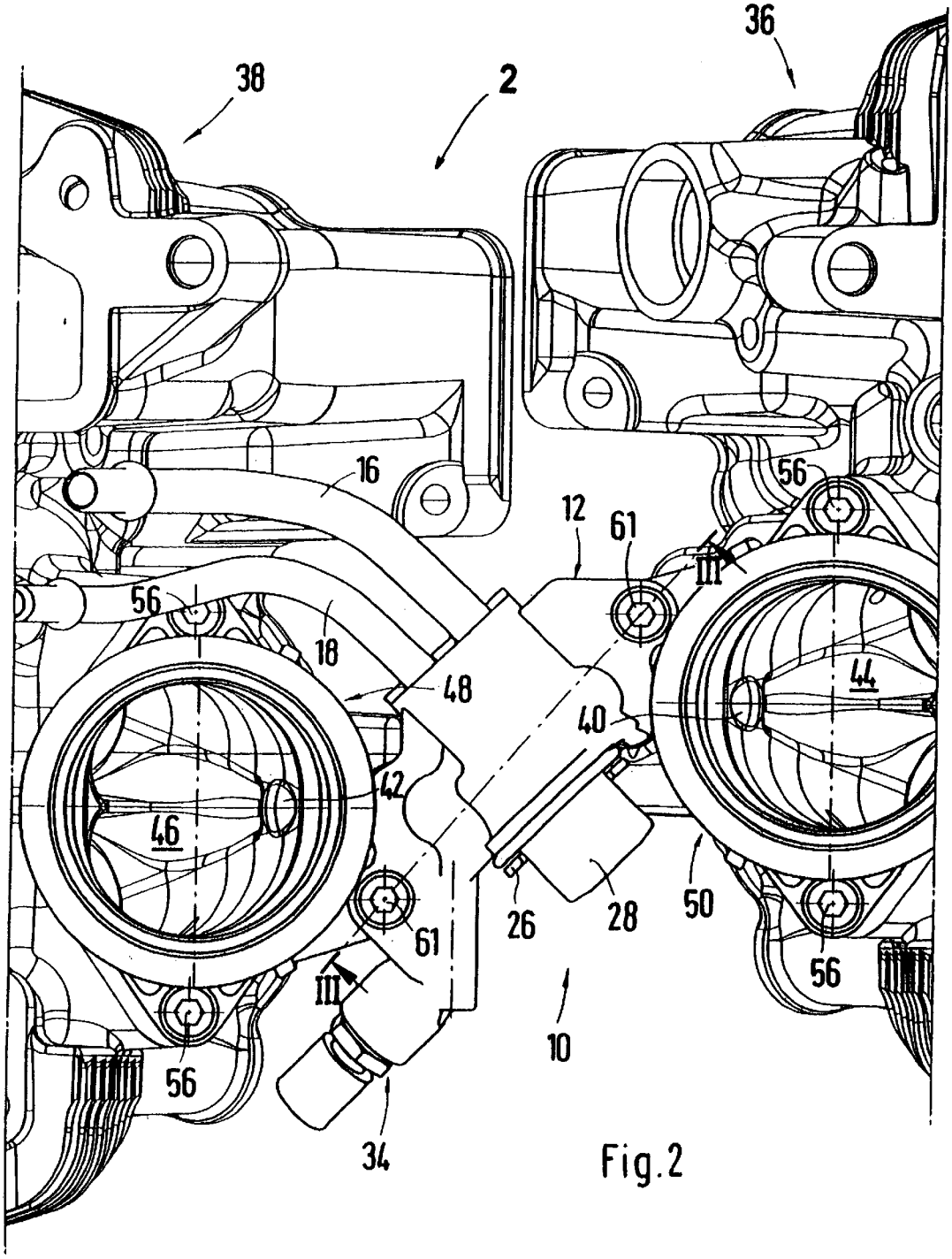
FIG. 2 is a top view of the internal-combustion engine in FIG. 1.
Figure 4:
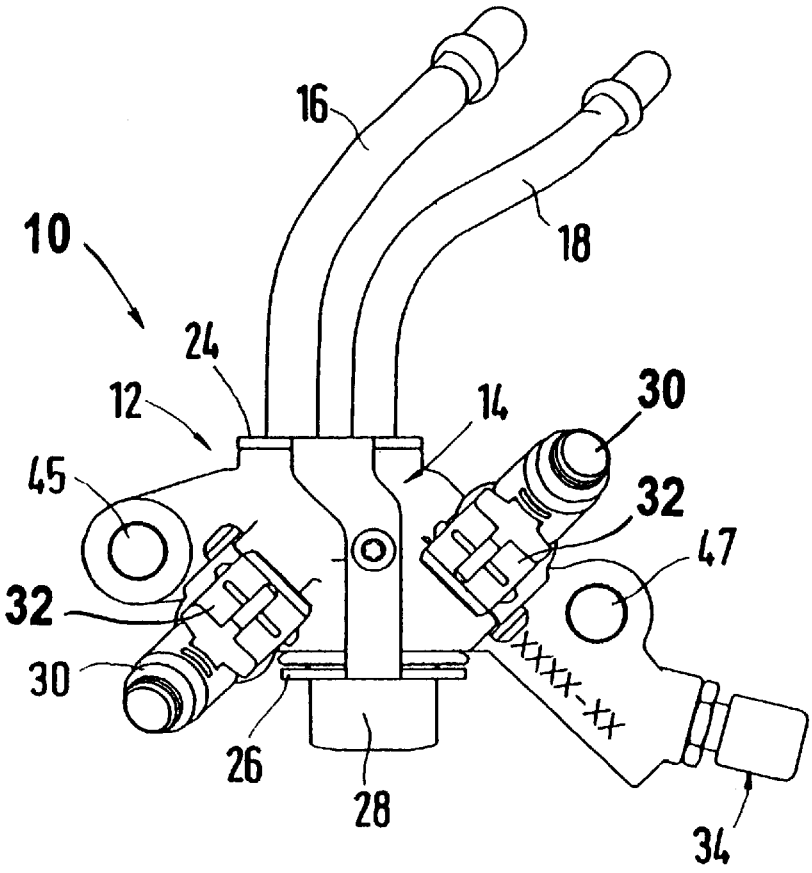
FIGS. 4 and 5 are two different side views of the fuel supply device.
Figure 5:
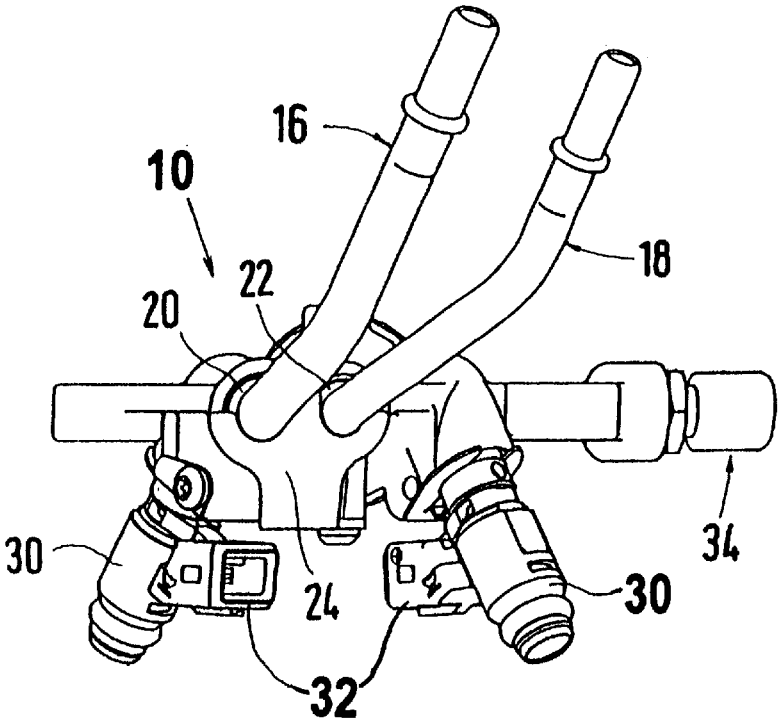
Figure 6:
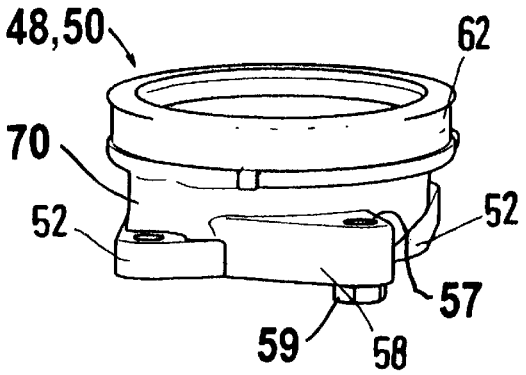
FIG. 6 is a perspective view of an air intake connection.
Figure 7:
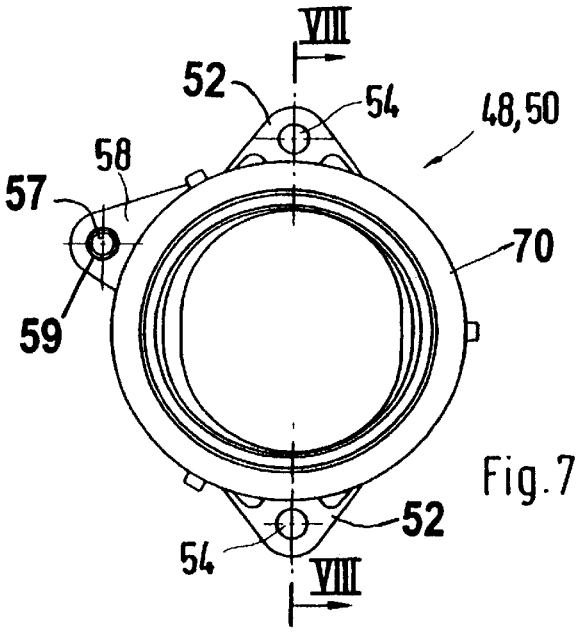
FIG. 7 is a top view of the air intake connection of FIG. 6.
Figure 8:
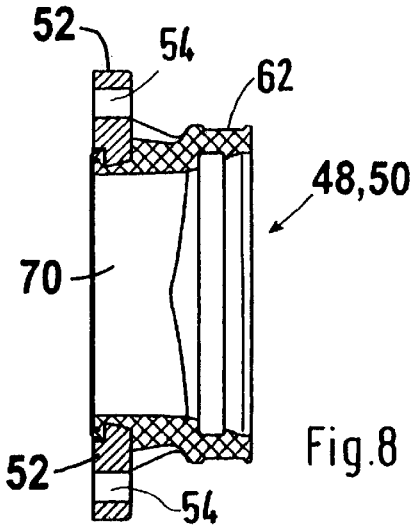
FIG. 8 is a section view taken along the line VIII—VIII of FIG. 7.
Figure 9:
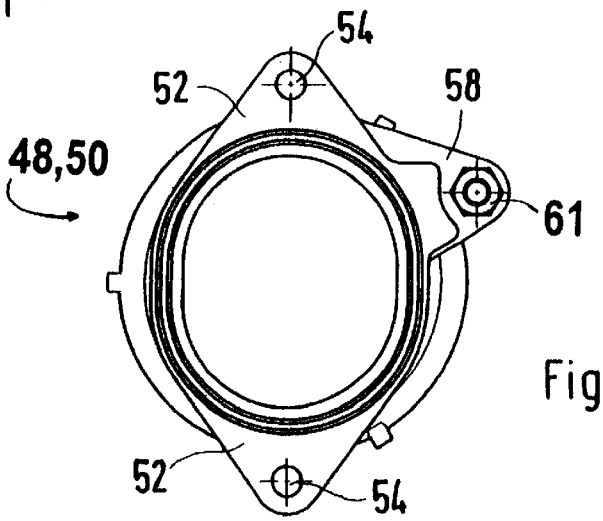
FIG. 9 is a bottom view of the air intake connection of FIG. 7.

A four-stroke two cylinder engine 2, the two cylinder heads 36, 38 of which are arranged in a V-shape, is illustrated in FIGS. 1 and 2. The engine 2 has a fuel supply device 10 which includes a fuel supply line 16 and a fuel return line 18, both of which are fastened to a fuel supply housing 12 (see FIGS. 2 and 4) with the aid of a retaining clip 14 (shown in FIGS. 4 and 5). The retaining clip 14 is U-shaped and is bolted onto the fuel supply housing 12. The retaining clip 14 has a first retaining arm 24 provided with two openings 20, 22. The fuel supply line 16 and fuel return line 18 pass through the openings 20, 22 and are connected to the fuel supply device 10 by the retaining arm 24. The fuel supply housing 12 has two fastening lugs 45, 47 (shown in FIG. 4) for securing the fuel supply housing 12 to the air intake connections 48, 50.

A second retaining arm 26, provided with a semicircular opening (not shown), is used for fastening a fuel pressure control valve 28 (shown in FIGS. 3 and 4) to the fuel supply device 10. A pressure control chamber 33 is located within the pressure control valve 28. A test valve 34 (shown in FIGS. 1 and 2), for testing the pressure in the engine 2, is connected to the pressure control valve 28. The fuel supply line 16 supplies fuel to the injection valves 30 from a fuel source (not shown). Two injection valves 30 are coupled to, and are in fluid communication with, the fuel supply device 10. Electrical connections 32 are mounted on the injection valves 30 so that the injection valves 30 can be controlled by a controller (not shown).

The cylinder heads 36, 38 have air intake connections 44, 46 (see FIG. 2) which draw air into the insertion openings 40, 42. The insertion openings 40, 42 are in fluid communication with, and supply air to, the injection valves 30. FIGS. 1 and 2 show two air intake connections 48, 50 located adjacent the two cylinder heads 36, 38. The fuel supply device 10 is mounted to the two air intake connections 48, 50 and extends across the engine 2 between the two air intake connections 48, 50.

With reference to FIGS. 6–9, the air intake connections 48, 50 are substantially identical and each has a body portion 70, a projection 58, and a fastening flange 52. The fastening flanges 52 extend radially from the air intake connections 48, 50 and have fastening openings 54 for mounting the air intake connections 48, 50 to the cylinder heads 36, 38. The fastening openings 54 extend through the flanges 52 and are adapted to receive threaded fasteners 56 (see FIG. 1) for coupling the air intake connections 48, 50 to the cylinder heads 36, 38. The threaded fasteners 56 extend through the fastening openings 54 and are threaded into the cylinder heads 36, 38. The fastening flanges 52 are preferably made from a relatively non-resilient material, such as aluminum, so that the air intake connections 48, 50 can be coupled relatively firmly to the cylinder heads 36, 38 and so that the connection between the air intake connections 48, 50 and the cylinder heads 36, 38 is relatively inelastic.

Figure 3:
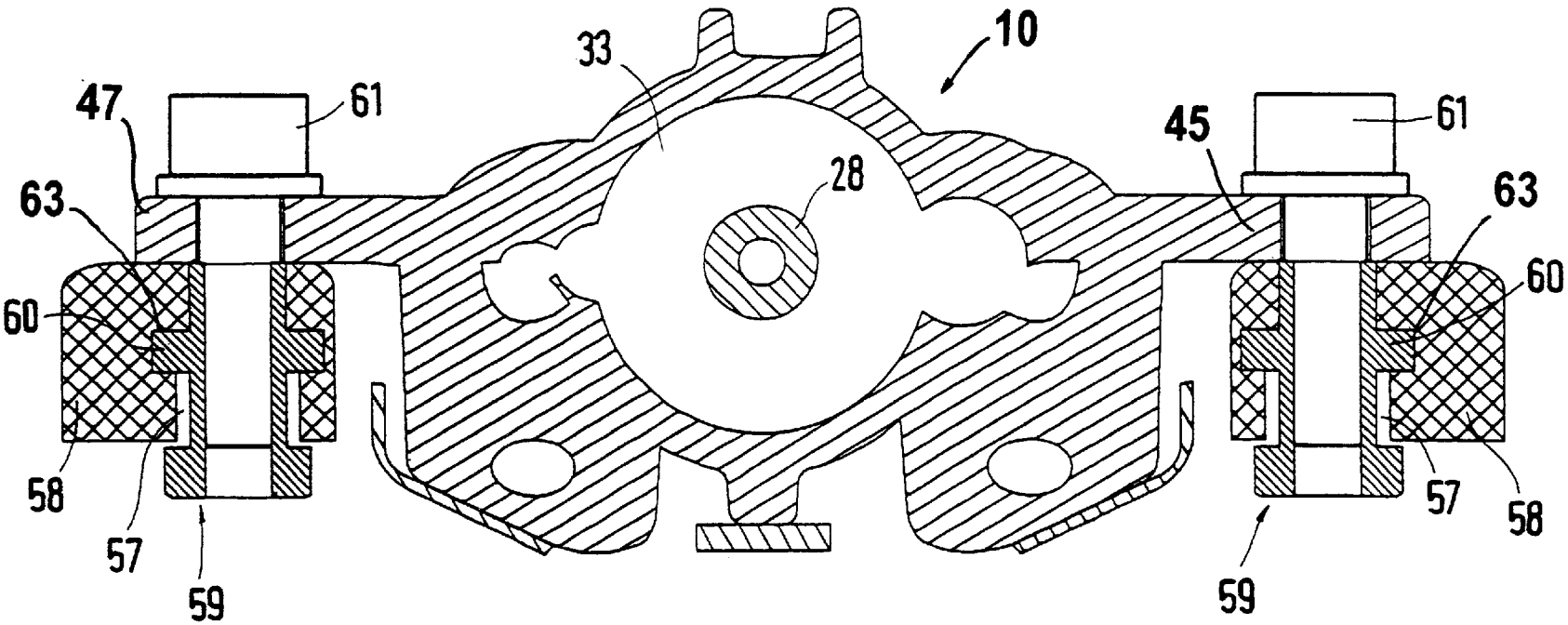
FIG. 3 is a section view taken along the line III—III of FIG. 2.

Preferably, the body portion 70 and the projection 58 are made of a relatively resilient material, such as rubber, so that they can bend and deform when thermal expansion causes the elements in the engine 2 to move relative to the fuel supply device 10 (described in greater detail below). The projection 58 extends radially from each of the air intake connections 48, 50. As best seen in FIG. 3, an aperture 57 extends through the projections 58 and is adapted to receive a sleeve 59 in positive locking engagement. The sleeve 59 is preferably metal. The apertures 57 each have an annular recess 63, which extends into the projections 58. The sleeves 59 are relatively cylindrical inserts, adapted to fit into the apertures 57 in the projections 58. An annular protrusion 60 extends radially around each of the sleeves 59 and is adapted to engage the annular recesses 63 in positive locking engagement. The sleeves 59 are inserted into the apertures 57 and the annular protrusions 60 slide into mating engagement with the annular recesses 63 to hold the sleeves 59 in the apertures 57. In this way, the sleeves 59 can rotate in the apertures 57 without tearing or damaging the projections 58. However, the sleeves 59 are held in the apertures 57 by the annular protrusions 60 even when the sleeves 59 are rotated within the apertures 57.

The sleeves 59 are preferably internally threaded to receive fasteners 61. The fasteners 61 can be any type of threaded fasteners, such as screws, bolts, and the like. The fasteners 61 are threaded through the fastening lugs 45, 47 and into the sleeves 59, thereby fixing the fuel supply device 10 to the air intake connections 48, 50. As shown in FIG. 3, the fuel supply device 10 is coupled to two projections 58, one on each of the air intake connections 48, 50.

Figure 10:
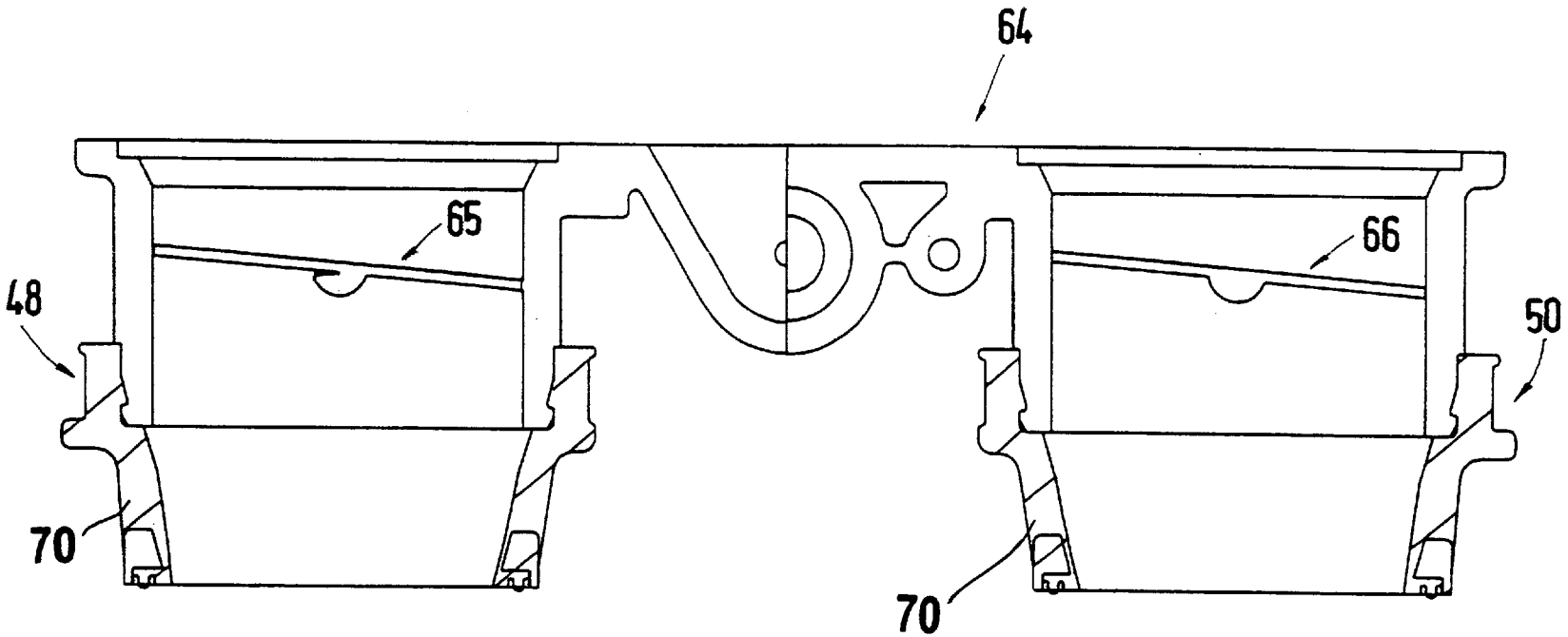
FIG. 10 is a side view of a throttle valve housing mounted on two air intake connections.

The end of the air intake connections 48, 50 opposite the fastening flanges 52 has an annular groove 62 formed of rubber. A clamp (not shown) coupled to the annular groove 62 secures a throttle valve housing 64 (shown in FIG. 10) in the two air intake connections 48, 50. The throttle valve housing 64 includes two throttle valves 65, 66 mounted for rotation adjacent respective air intake connections 48, 50 to regulate the quantity of air which is drawn into the air intake connections 48, 50.

During operation, the engine 2 generates heat. While some of this heat is transmitted to the surrounding environment, the various elements and components of the engine 2 become relatively hot during operation of the engine 2. The various elements and components of the engine are spaced at different points throughout the engine 2 so that some of the elements and components receive relatively more heat than others. Additionally, some of the components and elements are configured in such a way that they are cooled by the environment or are more able to transfer heat to the environment, thereby maintaining those elements and components at relatively cool temperatures. In this manner, the various components and elements of the engine 2 can be at significantly different temperatures at any given time. The various components and elements of the engine 2 are also made of different materials which respond differently to the temperature change, expanding and moving relative to one another. This thermal expansion can cause the cylinder heads 36, 38 to move relative to one another.

Because the air intake connections 48, 50 and the projections 58 are made of a relatively resilient material, the fuel supply device 10 remains securely fastened to the air intake connections 48, 50, even when thermal expansion causes alterations in the distance between the air intake connections 48, 50 and the projections 58. The projections 58 are compressed, stretched, and twisted so that the fastening lugs 45, 47 remain coupled to the projections 58 while the cylinder heads 36, 38 and the air intake connections 48, 50 move relative to one another as a result of thermal expansion. In this manner, the elasticity of the projections 58 serves to insulate the fuel supply device 10 from the effects of thermal expansion.

Additionally, because the air intake connections 48, 50 and the projections 58 are made of relatively resilient material they are relatively elastic. The elasticity of the air intake connections 48, 50 and the projections 58 helps to isolate the fuel supply device 10 from engine vibration, thereby allowing the fuel supply device 10 to be mounted relatively close to the engine 2. This is particularly advantageous because by mounting the fuel supply device 10 relatively closely to the engine 2, the fuel does not need to travel large distances to and from the fuel supply device 10, thus improving the operating efficiency of the engine 2.

Figure 11:
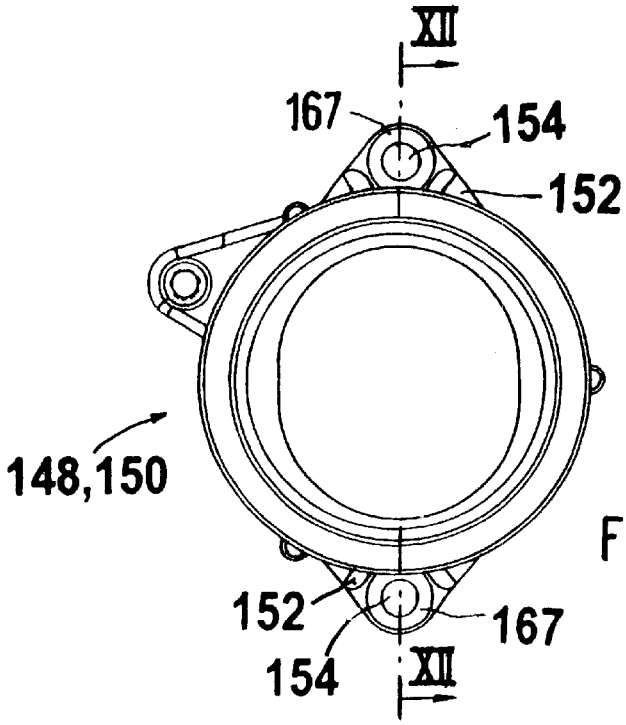
FIG. 11 is a top view showing an alternative embodiment of an air intake connection.
Figure 12:
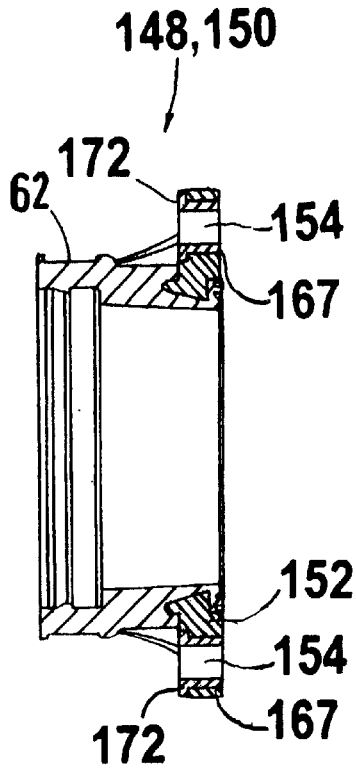
FIG. 12 is a section view taken along the line XII—XII of FIG. 11.

In a second embodiment of the air intake connection, illustrated in FIGS. 11 and 12, the fastening flanges 152 of the two air intake connections 148, 150 are made of a plastic material. The fastening flanges 152 each have a fastening opening 154 that extends through the fastening flanges 152. In order to ensure a secure and durable fastening of the fastening flanges 152 to the cylinder heads 36, 38, the fastening openings 154 are lined with a sleeve 167. Preferably, the sleeve 167 is metal. The sleeves 167 each have an annular lip 172 that extends radially around one end of the sleeve 167. When the sleeves 167 are inserted into the fastening openings 154, the lips 172 rest against the fastening flanges 152, securing the sleeves 167 to the fastening flanges 152. The sleeves 167 serve as buffers between the fastening flanges 152 and the threaded fasteners (not shown) that secure the fastening flanges 152 to the cylinder heads (not shown) so that the threaded fasteners do not damage the fastening flanges 152.

The embodiments described above and illustrated in the drawings are presented by way of example only and are not intended as a limitation upon the concepts and principles of the present invention. As such, it will be appreciated by one having ordinary skill in the art, that various changes in the elements and their configuration and arrangement are possible without departing from the spirit and scope of the present invention as set forth in the appended claims. For example, while various elements and assemblies of the present invention are described as being used with an engine 2 having two air intake connections 48, 50, one having ordinary skill in the art will appreciate that the present invention can also be used with engines 2 having one, three, or four air intake connections 48, 50. Similarly, in the illustrated embodiment, two fastening flanges 54 extend radially from the body portion 70. However, one having ordinary skill in the art will appreciate that one, three, four, or any other number of fastening flanges 54 can also be used to couple the air intake connections 48, 50 to the cylinder heads 36, 38. As such, the functions of the various elements and assemblies of the present invention can be changed to a significant degree without departing from the spirit and scope of the present invention.

What is claimed is:

1. An air intake connection adapted to be coupled to an air intake port of a motorcycle engine, the air intake connection comprising:

a body portion made of a first, resilient material and having a projection extending radially therefrom; and a flange made of a second, non-resilient material and extending radially from the body portion.

2. An air intake connection as claimed in claim 1, wherein the flange is aluminum.

3. An air intake connection as claimed in claim 1, wherein the first resilient material is rubber.

4. An air intake connection as claimed in claim 1, wherein the projection includes an aperture extending therethrough.

5. An air intake connection as claimed in claim 4, further comprising a metal sleeve in the aperture for receiving a fastener.

6. An air intake connection as claimed in claim 5, further comprising an annular protrusion on the metal sleeve, and wherein the aperture includes an annular recess adapted to receive the annular protrusion in positive locking engagement.

7. An air intake connection as claimed in claim 5, wherein the metal sleeve is internally threaded.

8. An air intake connection as claimed in claim 5, wherein the metal sleeve is rotatable with respect to the aperture.

9. An air intake connection adapted to be coupled to an air intake port of a motorcycle engine, the air intake connection comprising:

a body portion having a projection extending radially therefrom;

a flange extending radially from the body portion;

an aperture extending through the projection; and a sleeve in the aperture for receiving a fastener.

10. An air intake connection as claimed in claim 9, wherein the sleeve is metal.

11. An air intake connection as claimed in claim 9, further comprising an annular protrusion on the sleeve, and wherein the aperture includes an annular recess adapted to receive the annular protrusion in positive locking engagement.

12. An air intake connection as claimed in claim 9, wherein the sleeve is rotatable with respect to the aperture.

13. An air intake connection as claimed in claim 9, wherein the sleeve is made of a first material and the projection is made of a second material.

14. An internal combustion engine for a motorcycle, the engine comprising:

a cylinder head;

a fuel supply device; and an air intake connection including:

a body portion made of a first, resilient material and having a projection extending radially therefrom for coupling the fuel supply device to the air intake connection; and a flange made of a second, non-resilient material and extending radially from the body portion for coupling the air intake connection to the cylinder head.

15. An engine as claimed in claim 14, wherein the flange is aluminum.

16. An engine as claimed in claim 14, wherein the first resilient material is rubber.

17. An engine as claimed in claim 14, wherein the projection includes an aperture extending therethrough.

18. An engine as claimed in claim 17, further comprising a metal sleeve in the aperture for receiving a fastener.

19. An engine as claimed in claim 18, further comprising an annular protrusion on the metal sleeve, and wherein the aperture includes an annular recess adapted to receive the annular protrusion in positive locking engagement.

20. An engine as claimed in claim 18, wherein the metal sleeve is internally threaded.

21. An engine as claimed in claim 18, wherein the metal sleeve is rotatable with respect to the aperture.

22. An internal combustion engine for a motorcycle, the engine comprising:

a cylinder head;

a fuel supply device; and an air intake connection including:

a body portion having a projection extending radially therefrom for coupling the fuel supply device to the air intake connection;

a flange extending radially from the body portion for coupling the air intake connection to the cylinder head;

an aperture extending through the projection; and a sleeve in the aperture for receiving a fastener that couples the fuel supply device to the air intake connection.

23. An engine as claimed in claim 22, wherein the sleeve is metal.

24. An engine as claimed in claim 22, further comprising an annular protrusion on the sleeve, and wherein the aperture includes an annular recess adapted to receive the annular protrusion in positive locking engagement.

25. An engine as claimed in claim 22, wherein the sleeve is rotatable with respect to the aperture.

26. An engine as claimed in claim 22, wherein the sleeve is made of a first material and the projection is made of a second material.

27. A method of securing a fuel supply device to an engine, the engine including a cylinder head and an air intake connection having a body portion made of a first, resilient material, a projection extending radially from the body portion, the projection having an aperture extending therethrough, and a flange made of a second, non-resilient material, the flange extending radially from the body portion, the method comprising:

fastening the flange of the air intake connection to the cylinder head;

providing a fuel supply device having a fastening lug with an aperture extending therethrough;

aligning the aperture of the fastening lug and the aperture of the projection; and inserting a fastener through the aligned apertures to secure the fuel supply device to the air intake connection.

28. The method as claimed in claim 27, further comprising inserting a sleeve into the aperture extending through the projection prior to inserting the fastener.

29. The method as claimed in claim 28, further comprising:

applying torque to the fastener to secure the fuel supply device to the air intake connection; and rotating the sleeve relative to the aperture in the projection while applying torque such that the projection is not damaged by the applied torque.

* * * * *